US006276326B1

(12) United States Patent
Martinsson et al.

(10) Patent No.: US 6,276,326 B1
(45) Date of Patent: Aug. 21, 2001

(54) CONNECTING DEVICE FOR A FUEL SUPPLY UNIT

(75) Inventors: Pär Martinsson, Jönköping; Jörgen Pettersson, Huskvarna, both of (SE)

(73) Assignee: Aktiebolaget Electrolux, Stockholm (SE)

( * ) Notice: Subject to any disclaimer, the term of this patent is extended or adjusted under 35 U.S.C. 154(b) by 0 days.

(21) Appl. No.: 09/555,281

(22) PCT Filed: Nov. 24, 1998

(86) PCT No.: PCT/SE98/02125

§ 371 Date: May 26, 2000

§ 102(e) Date: May 26, 2000

(87) PCT Pub. No.: WO99/31378

PCT Pub. Date: Jun. 24, 1999

(30) Foreign Application Priority Data

Nov. 28, 1997 (SE) ..... 9704385

(51) Int. Cl.[7] ..... F02M 35/10

(52) U.S. Cl. ..... 123/184.23; 123/184.46; 123/73 A

(58) Field of Search ..... 123/184.23, 184.46, 123/184.61, 73 A; 285/110

(56) References Cited

U.S. PATENT DOCUMENTS

| | | | | |
|---|---|---|---|---|
| 3,652,074 | * | 3/1972 | Frederickson et al. | 267/137 |
| 3,680,608 | | 8/1972 | Emmerich et al. . | |
| 4,224,919 | * | 9/1980 | Appelbaum | 123/195 A |
| 4,819,589 | | 4/1989 | Nagashima . | |
| 5,065,708 | | 11/1991 | Wehle et al. . | |
| 5,105,778 | | 4/1992 | Svensson . | |
| 5,474,039 | * | 12/1995 | Döragrip | 123/184.55 |

* cited by examiner

*Primary Examiner*—Noah P. Kamen
(74) *Attorney, Agent, or Firm*—Pearne & Gordon LLP

(57) ABSTRACT

A connecting device (1) for a fuel supply unit (2), such as a carburetor, to a cylinder (3) of an internal combustion engine, said connecting device is mainly composed of a flexible inlet bellow (4) with an inlet duct (5). The bellow (4) has at its one end a first flange part (6), which surrounds the inlet duct and furthest out has a projecting outer edge (7) intended to be pushed upon a projecting inlet stud (8) of the cylinder, and the inlet bellow is at its other end mounted to the fuel supply unit (2). The inlet stud (8) has besides an inlet opening (13) at least one cavity (14) by the side of the inlet opening and the inlet bellow is arranged with at least one from the first flange part (6) projecting nose part (15) intended to protrude into the cavity (14) when the inlet bellow in an axial direction is being pushed upon the inlet stud (8).

8 Claims, 1 Drawing Sheet

CONNECTING DEVICE FOR A FUEL SUPPLY UNIT

TECHNICAL FIELD

The subject invention refers to a connecting device for a fuel supply unit, such as a carburetor, to a cylinder of an internal combustion engine, said connecting device is mainly composed of a flexible inlet bellow with inlet duct. The bellow has at its one end a first flange part, which surrounds the inlet duct and furthest out has a projecting outer edge intended to be pushed upon a projecting inlet stud of the cylinder, and the bellow is at its other end mounted to the fuel supply unit.

BACKGROUND OF THE INVENTION

Internal combustion engines of small size are often equipped with a carburetor since this is a simple and inexpensive fuel supply unit. However, the functioning of the carburetor can be disturbed by the engine vibrations, especially if these vibrations are comparatively substantial. This is often the case with smaller one-cylinder engines. Furthermore, in a portable working tool, such as a chain saw, the power unit is spring-suspended in the tool unit, i.e. a so called anti-vibration suspension. It means that the vibrations will decrease in the tool while they as a rule will increase in the actual spring-suspended power unit. It is often desirable to create an anti-vibration suspension also for the carburetor itself, however, this is often complicated by the fact that the carburetor is situated close to the engine's cylinder. In such an anti-vibration carburetor suspension arrangement a flexible rubber bellow is being used as a connection between the carburetor and the cylinder. Air and fuel from the carburetor flow trough the bellow into the cylinder. As a rule pressure pulses from the engine's crankcase are used for pumping fuel into the carburetor. This implies a duct to be drawn from the engine's crankcase over to the carburetor. Obviously this can be effected in that both the crankcase and the carburetor axe equipped with an inlet nipple each, and these both nipples are connected by a hose. Such an arrangement is however relatively sensitive to damages at the same time as it is comparatively expensive. Therefore a solution has come up, where the inlet bellow proper is equipped with an extra duct for transferring said pressure pulses from the crankcase. This duct is lead beside the larger inlet duct. This solution will result in two disadvantages. Firstly, the arrangement with a small extra duct will result in a high cost for the bellow, and secondly this extra duct, which is associated with the larger inlet duct, will result in an essential stiffening of the entire inlet bellow. This is not desirable since vibrations are then easier transferred from the engine's cylinder onto the carburetor.

A similar design is used for the bellow of the chain saw model Stihl 017. However its carburetor is fixedly mounted to the power unit. There is therefore no anti-vibration suspension for the carburetor itself. Its inlet bellow also has an extra duct connected to the inlet duct in its entire length. This also results in an expensive and very stiff inlet bellow. The stiffness of the bellow is even used to accomplish, or contribute to, the sealing function at the area where the extra duct meets the cylinder. The extra duct of the inlet bellow ends up in a nose part with a conical exterior that is pushed into an aperture with a corresponding conical shape. When the carburetor is bolted to a part, to which also the cylinder is fixed, the conical nose part and the extra channel will be squeezed into the conical aperture to accomplish a sealing function.

The inlet bellow has a first flange part which has a projecting outer edge that is pushed upon a projecting inlet stud of the cylinder. A ring is pushed over the outer edge to accomplish sealing against the inlet stud. The inlet stud has no grooves or similar to create an axial fixation of the bellow. This fixation instead seems to be accomplished in that the carburetor pushes the very stiff bellow against the inlet stud. The very stiff bellow would be completely unsuitable for an anti-vibration suspension for the carburetor itself. And such a suspension is also not used in this chain saw model.

PURPOSE OF THE INVENTION

The purpose of the subject invention is to substantially reduce the above outlined problems, and to achieve advantages in many respects.

SUMMARY OF THE INVENTION

The above mentioned purpose is achieved in that the connecting device in accordance with the invention is having the characteristics appearing from the appended claims. The connecting device, according to the invention, is thus essentially characterized in that the inlet stud besides an inlet opening has at least one cavity by the side of the inlet opening, and the inlet bellow is arranged with at least one from the first flange part projecting nose part intended to protrude into the cavity when the inlet bellow is being pushed upon the inlet stud in an axial direction. The projecting nose part is thus protruding into the cavity when mounting the bellow. Since the inlet stud normally has a round outer diameter the nose part will serve as a guide, thus preventing the inlet bellow from being mounted in an inappropriate angular position. A round inlet stud is preferable from many points of view, above all the quality of sealing when mounted.

In a further developed embodiment of the invention the cavity and the nose part is used for connecting a smaller duct extending from the engine crankcase through the cylinder over to the carburetor. The pressure pulses from the crankcase could then be used for pumping fuel in the carburetor, or in another fuel supply unit. But obviously this system can also be used for another duct which one wish to have drawn out from the cylinder over to some adjacent unit. The nose part is in this respect adapted to the opening so that it seals when being pushed into the opening. These and other characteristic features and advantages will become more apparent from the following detailed description of various embodiments with the support of the annexed drawing.

BRIEF DESCRIPTION OF THE DRAWING

The invention will be described in closer detail in the following by way of various embodiments thereof with reference to the accompanying drawing figures.

DESCRIPTION OF EMBODIMENTS

Figure 1:
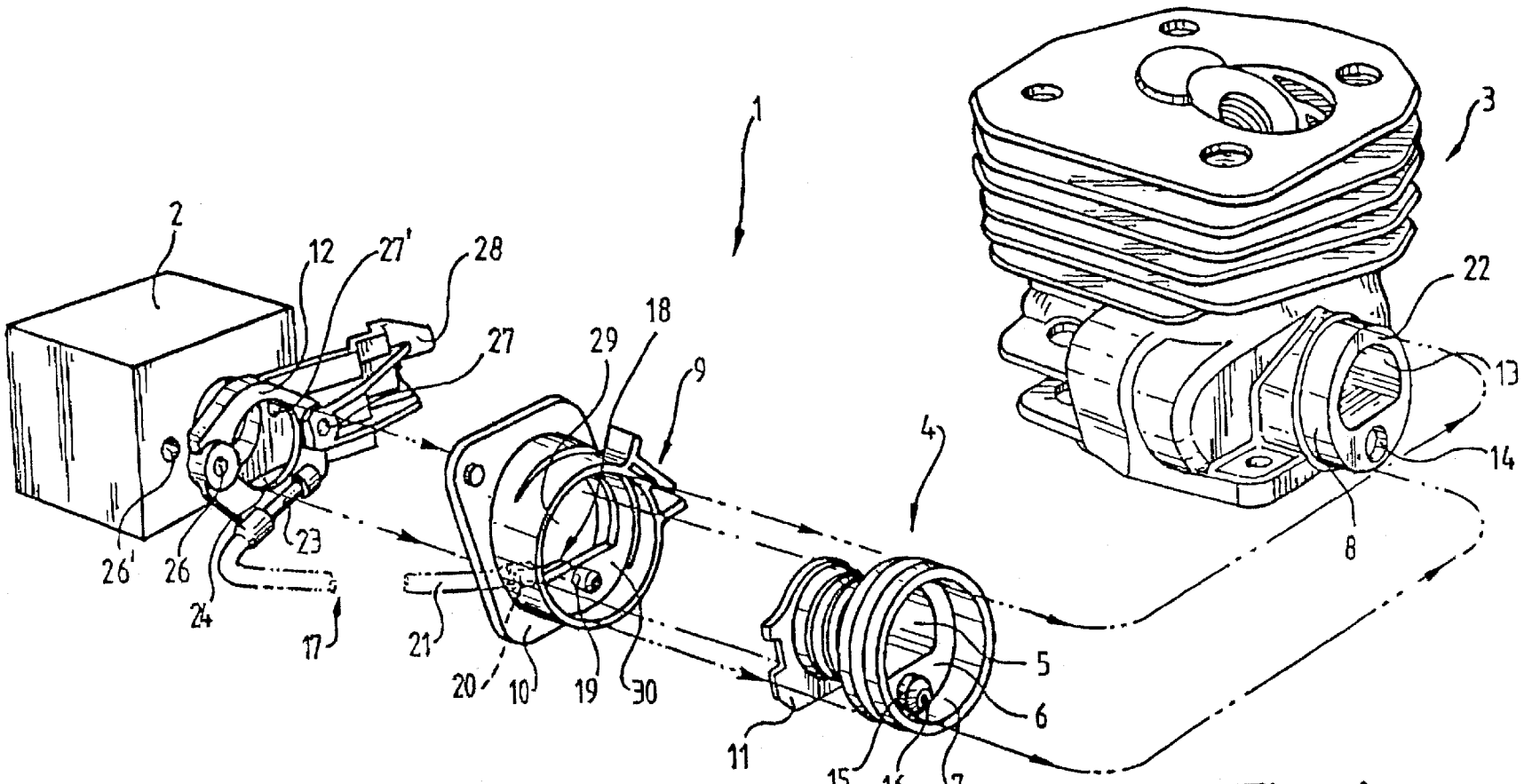
FIG. 1 shows schematically and seen in perspective a connecting device according to the invention. The parts are shown in an exploded view manner and with a special orientation so that the interaction between the inlet bellow and the cylinder will become more apparent. The inlet bellow and the following parts should therefore be moved forwards according to the drawn arrows and thus be turned 180° before mounting.

In FIG. 1 numeral reference 1 designates a connecting device according to the invention, intended for a fuel supply unit 2. The connecting device is mainly composed of a flexible inlet bellow 4 with an inlet duct 5. The bellow has at its one end a first flange part 6 which surrounds the inlet duct and furthest out has a projecting outer edge 7. This outer edge is intended to be pushed upon a projecting inlet stud 8 of the cylinder. The external shape of the inlet stud 8 is preferably round in order to provide a satisfactory scaling against the bellow, however, also other kind of shapes could be conceivable. When the inlet bellow is being pushed upon the inlet stud 8 it is important that an inlet opening 13 in the cylinder corresponds to the inlet duct 5 in the bellow. A nose part 15 is protruding from the first flange part 6, which surrounds the inlet duct 5 in the bellow 4. The nose part 15 is intended to protrude into a cavity 14 of the inlet stud. Hereby a desirable guide is created, on the one hand ensuring that the inlet opening and the inlet duct will correspond, and on the other hand that the fuel supply unit will end up into a desirable angular position. Obviously the fuel supply unit can also be mounted in other ways, but a main purpose of a flexible inlet bellow is that an anti-vibration mounting of the fuel supply unit is created. The bellow 4 is therefore preferably made of some kind of rubber material and so designed that its stiffness is diminutive and thereby transfers as less vibrations as possible to the fuel supply unit.

As mentioned above the nose part 15 and the cavity 14 could be designed so that they form a duct leading out from the cylinder. Preferably the cavity 14 will then connect to a duct, which leads into the cylinder and further on, so that it connects to the engine crankcase. The nose part is provided with at least one duct 16 intended to connect to a duct 17, which preferably leads to the fuel supply unit. In the shown embodiment the cavity 14 is designed as a cylindrical aperture 14 located beside the inlet opening. The nose part 15 is adapted to the aperture 14 and meant to be inserted into it when the inlet bellow in an axial direction is pushed upon the inlet stud. The nose part 15 as well as the bellow 4 are preferably made of a compliant rubber material. Owing to this the nose part 15 can be compressed somewhat when being inserted into the aperture, so that a sealing connection is obtained. Obviously the aperture 14 could also have a conical or non-circular shape. The first flange part 6 in the bellow corresponds to an end surface 22 of the inlet stud. Preferably both the flange part and the end surface have a plane surface, but they could also have other shapes.

The duct 17 is preferably arranged in that a tubular part 18 at its one end 19 has an adapted outer dimension, so that it can be inserted into the duct 16, and together with a hose 21 which is mounted to the tubular part's 18 other end 20 the duct 17 is arranged. The tubular part 18 is thus inserted into the duct 16 from its rear side, which is concealed in FIG. 1. This begins at the rear side of the first flange part 6 somewhat below the outside of the inlet duct 5. When the tubular part 18 is being inserted into the duct 16 it will expand the nose part 15 somewhat. This will result in an even safer sealing between the nose part 15 and the aperture 14. The tubular part 18 can be inserted into the duct 16 either when the bellow is mounted onto die inlet stud 8 or before mounting. Preferably the tubular part 18 is integrated in a partition wall 10, which is often used, but not necessary in all applications. In the shown embodiment the tubular part is integrated in the partition wall, and to its other end 20 a hose 21 is mounted, which leads to a carburetor flange. The carburetor flange has an integrated tubular connection 23. Both tubular parts 18 and 23 are so designed that the hose 21 can be pushed upon them and thus provide a sealing connection.

The inlet bellow 4 has at its other end an essentially plane second flange part 11, which surrounds the inlet duct. At mounting this flange part is pushed through an opening 24 in the carburetor flange 12. This is possible as the inlet bellow 4 is made of a flexible material, for example rubber. Hereby the flange part 11 will end up between the carburetor flange 12 and the fuel supply unit 2. The carburetor flange is mounted to the fuel supply unit by inserting screws into holes 26 and 27 in the carburetor flange and then fastening said screws into corresponding threaded holes 26' and 27' in the fuel supply unit. Hereby the second flange part 11 is sealingly squeezed between the carburetor flange 12 and the fuel supply unit. Obviously the carburetor flange could be fastened in other ways than by screws to the fuel supply unit. The tubular connection 23 is thus integrated in the carburetor flange 12. It means that the duct 17 leads into the carburetor flange and through it. It meets with an aperture in the second flange part 11 of the inlet bellow and this aperture corresponds in turn with an aperture in the carburetor 2. The second flange part 11 thus serves as a sealing for the duct 17 between the carburetor flange 12 and the carburetor 2. The carburetor flange is also provided with a screw driver guiding part 28. In this part there are two guide holes straight axially outside a respective adjustable nozzle in the carburetor. Hereby the screw driver guiding part is integrated into the carburetor flange, so that the carburetor itself does not have to be equipped with such kind of guide. The number of such guides can of course vary.

An important aspect of the invention is just the way how the duct 17 is running from the fuel supply unit over to the cylinder. It is lead adjacent to the inlet duct 5 without being connected to it. A solution where the duct 17 is integrated with the inlet duct 5 should result in a very substantial stiffening of the inlet bellow and would therefore be less successful. However, in his case the inlet bellow 4, which is supported by the inlet duct 5, can be made as soft as possible. This is advantageous considering the wanted anti-vibration design of the fuel supply unit. Still, at the same time the duct 17 can be kept within those details that can be pre-mounted into a kit. During such pre-mounting the second flange part is pushed through aperture 29 in the partition wall 10 and then the tubular part 18 is pressed into the duct 16. In this manner the first flange part 6 will be resting against a corresponding flange surface 30 in the partition wall 10. The second flange part is then pushed through aperture 24 in the carburetor flange 12, as earlier described. After mounting of the carburetor flange 12 to the fuel supply unit a complete unit is obtained, which can be connected to the cylinder. The partition wall 10 has a clamping device 9, which preferably should be adjusted after the different parts have been mounted to the cylinder. The clamping device is here composed of a snap fastener and functions as a hose clamp with quick-lock. It means that the outer edge 7 of the inlet bellow is kept fixed by the clamping device 9. In case a partition wall is not being used it could instead be fastened by a hose clamp, for example. But it could also be kept fixed in that the outer edge 7 is provided with holding pins inwards, or, a surrounding edge inwards. These holding pins connect to holding edges of the inlet stud 8 The inlet stud could for instance have an all around going groove, in which holding edges of the outer edge 7 could catch hold. In case the partition wall is not used, preferably the tubular part 18 should be used separately. Alternatively, a hose 21 could be integrated directly in the inlet bellow.

What is claimed is:

1. A fuel supply arrangement of an internal combustion engine, comprising a connecting device (1) for connecting a fuel supply unit (2) to a cylinder (3), said connecting device comprising a flexible inlet bellow (4) with an inlet duct (5), which bellow (4) has at its one end a first flange part (6), which surrounds the inlet duct and furthest out has a projecting outer edge (7) intended to be pushed upon a projecting inlet stud (8) of the cylinder, and the inlet bellow is at its other end mounted to the fuel supply unit (2) and the inlet stud (8) besides an inlet opening (13) has at least one cavity (14) by the side of the inlet opening, and the inlet bellow is arranged with at least one from the first flange part (6) projecting nose part (15) intended to protrude into the cavity (14) as the inlet bellow is being pushed upon the inlet stud (8) in an axial direction, characterized in that the nose part (15) is provided with at least one duct (16) intended to connect to a duct (17), which essentially is not connected or attached to the inlet duct (5).

2. A fuel supply arrangement according to claim 1, characterized in that the cavity is designed as a cylindrical aperture (14) beside the inlet opening, and the nose part (15) is adapted to the aperture (14) and intended to be inserted into it as the inlet bellow is pushed upon the inlet stud (8) in an axial direction.

3. A fuel supply arrangement according to claim 2, characterized in that the nose part (15) externally has a cylindrical shape.

4. A fuel supply arrangement according to claim 1 or 2 or 3, characterized in that a tubular part (18) at its one end (19) has an adapted outer dimension, so that it can be inserted into the duct (16), and together with a hose (21) which is mounted to the tubular part's (18) other end (20) the duct (17) is thus arranged.

5. A fuel supply arrangement according to claim 4, characterized in that the tubular part (18) is integrated in a partition wall (10).

6. A fuel supply arrangement according to claim 1 or 2 or 3, characterized in that the outer edge (7) of the inlet bellow (4) is kept fixed by a clamping device (9), said clamping device is selected to be one of a hose clamp and a clamping device arranged in a partition wall (10).

7. A fuel supply arrangement according to claim 1 or 2 or 3, characterized in that the inlet bellow (4) at its other end has an essentially plane second flange part (11), which surrounds the inlet duct and by way of a carburetor flange (12) mounted to the fuel supply unit (2) is intended to be sealingly squeezed against the fuel supply unit (2).

8. A fuel supply arrangement according to claim 7, characterized in that the carburetor flange (12) is provided with a tubular connection (23), to which the hose (21) can be connected, so that the tubular connection forms part of the duct (17) leading from the nose part (15) on to the fuel supply unit.

* * * * *

UNITED STATES PATENT AND TRADEMARK OFFICE

CERTIFICATE OF CORRECTION

PATENT NO. : 6,276,326 B1
DATED : August 21, 2001
INVENTOR(S) : Par Martinsson et al.

It is certified that error appears in the above-identified patent and that said Letters Patent is hereby corrected as shown below:

Title page,
Foreign Application Priority Data, please delete "9704385" and insert therefor -- 9704385-5 --.

Signed and Sealed this

Nineteenth Day of March, 2002

*Attest:*

*Attesting Officer*

JAMES E. ROGAN
*Director of the United States Patent and Trademark Office*